US011388941B2

(12) United States Patent
Moore

(10) Patent No.: US 11,388,941 B2
(45) **Date of Patent: *Jul. 19, 2022**

(54) HYDRATION SCARF WITH SECURING TABS FOR CONVENIENTLY CONTAINING, CARRYING, AND CONSUMING A BEVERAGE

(71) Applicant: Jodi Moore, Dayton, OH (US)

(72) Inventor: Jodi Moore, Dayton, OH (US)

( * ) Notice: Subject to any disclaimer, the term of this patent is extended or adjusted under 35 U.S.C. 154(b) by 4 days.

This patent is subject to a terminal disclaimer.

(21) Appl. No.: 16/903,330

(22) Filed: Jun. 16, 2020

(65) Prior Publication Data

US 2020/0305525 A1 Oct. 1, 2020

Related U.S. Application Data

(63) Continuation of application No. 15/844,544, filed on Dec. 16, 2017, now Pat. No. 10,709,184.

(51) Int. Cl.
*A41D 23/00* (2006.01)

(52) U.S. Cl.
CPC ..... *A41D 23/00* (2013.01); *A41D 2400/46* (2013.01)

(58) Field of Classification Search
CPC ..... A41D 23/00; A41D 2400/46; A45F 3/16; A45F 2003/166; A45F 3/20; A47G 21/18; A47G 21/186; A47G 19/2272; A47G 19/2266; B67D 1/0802
USPC ..... 2/207; 224/148.1, 148.2, 148.3, 148.4, 224/148.7; 220/705, 709, 710; 215/229; 222/464.1
See application file for complete search history.

(56) References Cited

U.S. PATENT DOCUMENTS 1,650,764 A 11/1927 Marin
4,090,650 A 5/1978 Gotta
(Continued)

FOREIGN PATENT DOCUMENTS

WO 198300608 3/1983
WO 198702873 3/1987
WO 2009007969 A2 1/2009

OTHER PUBLICATIONS

Website: http://wasa-bi.com/topics/1698—Downloaded Sep. 25, 2017
4mm Diameter Hydration Tube "Nano Drink Tube".
(Continued)

*Primary Examiner* — F Griffin Hall
(74) *Attorney, Agent, or Firm* — Russ Weinzimmer & Associates, P.C.

(57) ABSTRACT

A hydration scarf is provided to contain a beverage and be worn around the neck so as to make consumption of the beverage very convenient. The hydration scarf can be disposable and can be sold pre-filled. The hydration scarf can have a drinking straw assembly or can have a fluid port for receiving a re-usable drinking straw assembly. The hydration scarf includes a U-shaped container portion including: a first hanging portion, a curved portion, a second hanging portion, and a fluid port. Both the first hanging portion and the second hanging portion have at least one connection tab. The drinking straw assembly includes: a drinking straw, and a port connector. Also included is an internal tube assembly including: a first uptake tube, a second uptake tube, and a three-way connector in fluid communication with the fluid port, and directly connected to the first uptake tube and the second uptake tube.

1 Claim, 7 Drawing Sheets

(56) References Cited

U.S. PATENT DOCUMENTS

| | | | |
|---|---|---|---|
| 4,176,772 | A | 12/1979 | Danon |
| 4,265,381 | A | 5/1981 | Muscatell |
| 4,526,298 | A | 7/1985 | Boxer et al. |
| 4,544,087 | A | 10/1985 | Modig |
| 4,739,905 | A | 4/1988 | Nelson |
| 4,948,023 | A | 8/1990 | Tripp |
| 5,060,833 | A | 10/1991 | Edison et al. |
| 5,085,349 | A | 2/1992 | Fawcett |
| 5,207,362 | A | 5/1993 | Janus et al. |
| 5,431,308 | A | 7/1995 | Tchen |
| 5,571,260 | A | 11/1996 | Krug |
| 5,622,293 | A | 4/1997 | LeFevre |
| 5,645,404 | A | 7/1997 | Zelenak |
| 5,722,573 | A | 3/1998 | Carnel |
| 5,806,726 | A | 9/1998 | Ho |
| 5,940,880 | A | 8/1999 | Phillips |
| 5,984,145 | A | 11/1999 | McAllister |
| 6,220,490 | B1 | 4/2001 | O'Hara |
| 6,283,344 | B1 | 9/2001 | Bradley |
| 6,581,811 | B1 | 6/2003 | Schillaci |
| 6,598,770 | B2 | 7/2003 | Bolts |
| 6,749,090 | B2 | 6/2004 | Bailey |
| 6,820,780 | B2 | 11/2004 | Forsman et al. |
| 7,497,186 | B2 | 3/2009 | Dorton et al. |
| 7,552,734 | B2 | 6/2009 | Adams |
| 7,766,193 | B2 | 8/2010 | Stollmann et al. |
| 8,082,753 | B1 | 12/2011 | Alvarez, Jr. et al. |
| 8,286,592 | B2 | 10/2012 | Moinester |
| 8,453,893 | B2 | 6/2013 | Shitaye |
| 8,544,688 | B2 | 10/2013 | Ballentine |
| 8,708,194 | B2 | 4/2014 | Pascatore |
| 9,314,119 | B2 | 4/2016 | Parker et al. |
| 9,591,911 | B2 | 3/2017 | Hopmeier |
| 10,709,184 | B2 * | 7/2020 | Moore ..... A41D 23/00 |
| 2002/0092858 | A1 | 7/2002 | Bowman |
| 2004/0128747 | A1 | 7/2004 | Bumbarger et al. |
| 2007/0028359 | A1 | 2/2007 | Robinson et al. |
| 2007/0090135 | A1 | 4/2007 | Benham |
| 2007/0221692 | A1 | 9/2007 | Witten |
| 2008/0185408 | A1 | 8/2008 | James |
| 2010/0084290 | A1 | 4/2010 | Anson et al. |
| 2011/0240703 | A1 | 10/2011 | Tobin et al. |
| 2013/0146623 | A1 | 6/2013 | Murray |
| 2013/0247271 | A1 | 9/2013 | Bowen et al. |
| 2013/0284762 | A1 | 10/2013 | Voss |
| 2017/0055495 | A1 | 3/2017 | Atkins |
| 2017/0129687 | A1 | 5/2017 | Atkins |

OTHER PUBLICATIONS

Website: https://www.revzilla.com/motorcycle/kriega-hands-free-hydration-tube—Downloaded Sep. 25, 2017 Kriega Hands-Free Hydration Tube.

Website: https://www.thegreenhead.com/2008/02/wine-rack-drink-dispensing-secret-bra-flask.php—Downloaded Sep. 25, 2017 Wine Rack Drink Dispensing Secret Bra Flask.

Website: http://baxbo.com/gifts/flasktie-flaskscarf/—Downloaded Sep. 25, 2017 Flask Scarf/Flask Tie.

Website: https://www.roguepak.com/—Downloaded Sep. 25, 2017 RoguePak Cartridge Hydration System.

YouTube: https://www.youtube.com/watch?v=Q3r5wNNUkAY—Downloaded Sep. 22, 2017 Wetsleeve—Wearable Hands-Free Hydration.

YouTube: https://www.youtube.com/watch?v=AL0XiMUNVs8—Downloaded Sep. 26, 2017 The SmartTube—a hydration pack alternative.

* cited by examiner 104
103
102
107
109
516
514
512
204
202
510
506
504
518
604
200
616
508
509
502'
610

HYDRATION SCARF WITH SECURING TABS FOR CONVENIENTLY CONTAINING, CARRYING, AND CONSUMING A BEVERAGE

CROSS-REFERENCE TO RELATED APPLICATIONS

The present application is a Continuation of application Ser. No. 15/844,544, filed Dec. 16, 2017, titled "A HYDRATION SCARF FOR CONVENIENTLY CONTAINING, CARRYING, AND CONSUMING A BEVERAGE", which is hereby incorporated by reference in its entirety.

FIELD OF THE INVENTION

This invention relates generally to beverage containers, and particularly to wearable beverage containers.

BACKGROUND OF THE INVENTION

There are many types of personal hydration devices that allow a user to drink hands-free, while engaging in activities such as jogging, hiking, bicycling, or other forms of physical exercise. Historically, examples of these can be worn around the waist, or on the user's back. Other examples can be worn as a vest, or can be carried over the shoulder, or can be worn on the user's head.

In addition, some examples of personal hydration devices can be worn around the user's neck. For example, Janus et al. U.S. Pat. No. 5,207,362 teaches a container for liquid that is secured all around a user's neck. However, the method of securing the container include straps and hook and loop fasteners, which can be difficult and time consuming to secure, and may restrict the user to wearing clothing that is compatible with the device. Also, the use of straps placed all around the neck can pose a safety risk, such as by strangulation caused by neck strap entanglement with nearby objects, for example. Also, Forsman et al. U.S. Pat. No. 6,820,780 also teaches a neck supported fluid reservoir that has a rigid support extending all around the neck, which may pose a similar safety risk of strangulation.

Many devices are inconvenient to use because they require the use of complex harnesses or other inconvenient attachment methods. For example, Boxer et al. U.S. Pat. No. 4,526,298 teaches a sport hydration system that requires a torso harness for mounting a liquid filled container.

Historically, several hydration devices have containers that are filled by the user, and then are re-used. The users of such devices may fill the hydration device in an unsanitary way, resulting in the consumption of unsanitary beverages. Or the user may fail to clean the hydration device after use, and then re-fill it with a sanitary liquid, thereby resulting in an unsanitary liquid. For example, Schillaci U.S. Pat. No. 6,581,811 B1 teaches a flexible wearable container that can be refilled by the user, and can therefore result in an unsanitary condition.

SUMMARY OF THE INVENTION

A hydration scarf is provided that can be filled with a beverage, and can be worn around the neck and carried so as to make consumption of the beverage easy and convenient. The hydration scarf can be disposable, and sold pre-filled by beverage manufacturers. The hydration scarf can be sold with an included drinking straw assembly, or can be sold with a fluid port that can receive a re-usable drinking straw assembly.

A general aspect of the invention is a hydration scarf for conveniently containing, carrying, and consuming a beverage. The hydration scarf includes: a U-shaped container portion which includes: a first hanging portion, a second hanging portion, a curved portion connecting the first hanging portion with the second hanging portion, and a fluid port located at a fluid port location along the U-shaped container portion. The hydration scarf also includes a drinking straw assembly which includes: a drinking straw having a first straw end and a second straw end, and a port connector attached to the second end of the straw, the port connector being configured to removably connect the second end of the straw to the fluid port; and an internal tube assembly disposed within the U-shaped container portion. The internal tube assembly includes: a first uptake tube configured to extend into the first hanging portion, a second uptake tube configured to extend into the second hanging portion, and a three-way connector in fluid communication with the fluid port, the three-way connector also being directly connected to the first uptake tube and the second uptake tube.

In some embodiments, the internal tube assembly further includes: an intermediate tube connected both to the three-way connector and to the fluid port.

In some embodiments, the hydration scarf further includes: a thermal insulation sheath covering at least some of the curved portion of the U-shaped container portion.

In some embodiments, the port connector is configured to removably connect to the fluid port without leaking.

In some embodiments, the drinking straw assembly includes a fluid pressure threshold valve.

In some embodiments, the fluid port includes a threaded portion.

In some embodiments, the U-shaped container portion includes at least one connection tab configured to attach to a user's garment.

In some embodiments, the drinking straw assembly includes: a straw cap for removably covering the first straw end of the drinking straw.

In some embodiments, the drinking straw having a first straw end and a second straw end includes: an accordion-folded portion between the first straw end and a second straw end.

In some embodiments, at least the first hanging portion, and the second hanging portion of the U-shaped container portion are made from a transparent and flexible material.

In some embodiments, the U-shaped container is pre-filled with a beverage ready to be consumed.

Another general aspect of the invention is a hydration scarf for conveniently containing, carrying, and consuming a beverage, this hydration scarf including: a U-shaped container portion which includes: a first hanging portion, a second hanging portion, a curved portion connecting the first hanging portion with the second hanging portion, and a fluid port located at a fluid port location along the U-shaped container portion; and an internal tube assembly disposed within the U-shaped container portion. The internal tube assembly includes: a first uptake tube configured to extend into the first hanging portion, a second uptake tube configured to extend into the second hanging portion, and a three-way connector in fluid communication with the fluid port, the three-way connector also being directly connected to the first uptake tube and the second uptake tube.

In some embodiments, the hydration scarf further includes: a drinking straw assembly that includes a drinking straw having a first straw end and a second straw end, and a port connector attached to the second end of the straw, the port connector being configured to removably connect the second end of the straw to the fluid port.

In some embodiments, the internal tube assembly further includes: an intermediate tube connected both to the three-way connector and to the fluid port.

In some embodiments, the hydration scarf further includes: a thermal insulation sheath covering at least some of the curved portion of the U-shaped container portion.

In some embodiments, the drinking straw assembly includes a fluid pressure threshold valve.

In some embodiments, the drinking straw assembly includes a straw cap for removably covering the first straw end of the drinking straw.

In some embodiments, the drinking straw having a first straw end and a second straw end includes an accordion-folded portion between the first straw end and a second straw end.

In some embodiments, at least the first hanging portion, and the second hanging portion of the U-shaped container portion are made from a transparent and flexible material.

In some embodiments, the U-shaped container is pre-filled with a beverage ready to be consumed.

BRIEF DESCRIPTION OF THE DRAWINGS

Many additional features and advantages will become apparent to those skilled in the art upon reading the following description, when considered in conjunction with the accompanying drawings, wherein.

DETAILED DESCRIPTION

Figure 1:
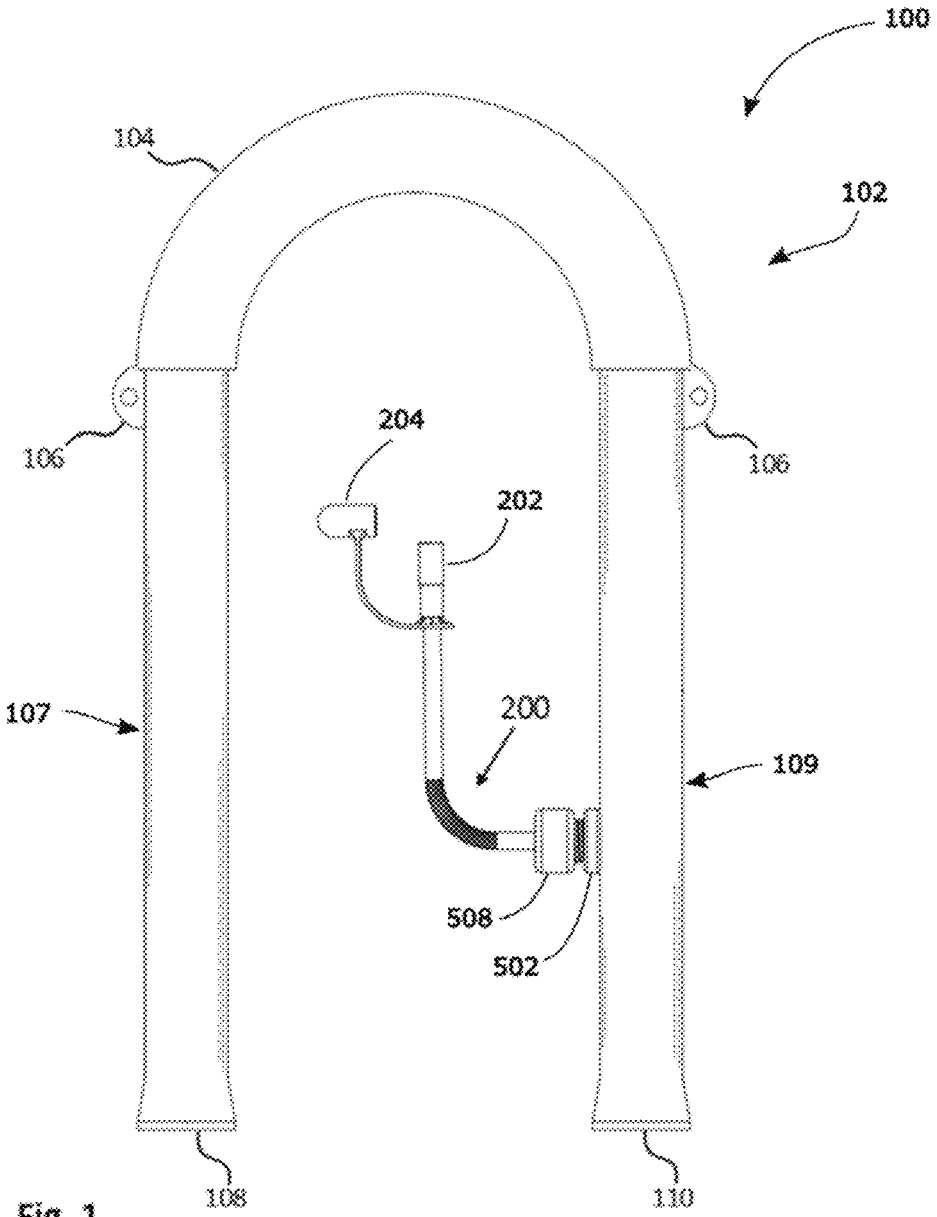
FIG. 1 is a front view of an embodiment of a hydration scarf according to the invention, showing a U-shaped container having an insulated upper portion, and a straw assembly for enabling consumption of a beverage contained in the U-shaped container.

With reference to FIG. 1, a hydration scarf 100 can be worn like a scarf by hanging it from the neck of a person. The hydration scarf 100 includes a single U-shaped beverage container 102, which can be covered along a curved portion by a thermal insulation sheath 104 which covers the curved portion 103 (see FIGS. 2 and 5), so as to inhibit heat transfer from the person's neck to the curved portion of the U-shaped container 102. This can help to reduce heat transfer from the U-shaped container 102 to the beverage contained in the U-shaped container 102. The thermal insulation sheath 104 can be made from a disposable material and can be provided with the hydration scarf 100. Or, the hydration scarf 100 can be made and sold without a thermal insulation sheath 104, and the user can provide their own insulation sleeve, and re-use the thermal insulation sheath 104.

The insulation sleeve can be held in place between the two tabs 106, which also serve to provide a place for securing the hydration scarf 100 to a garment worn by the person.

The U-shaped container 102 includes a first hanging portion 107 having a sealed end 108, and includes a second hanging portion 109 having a sealed end 110.

In fluid communication with the U-shaped container 102 is a straw assembly 200 for drinking a beverage contained in the hydration scarf 100.

Figure 2:
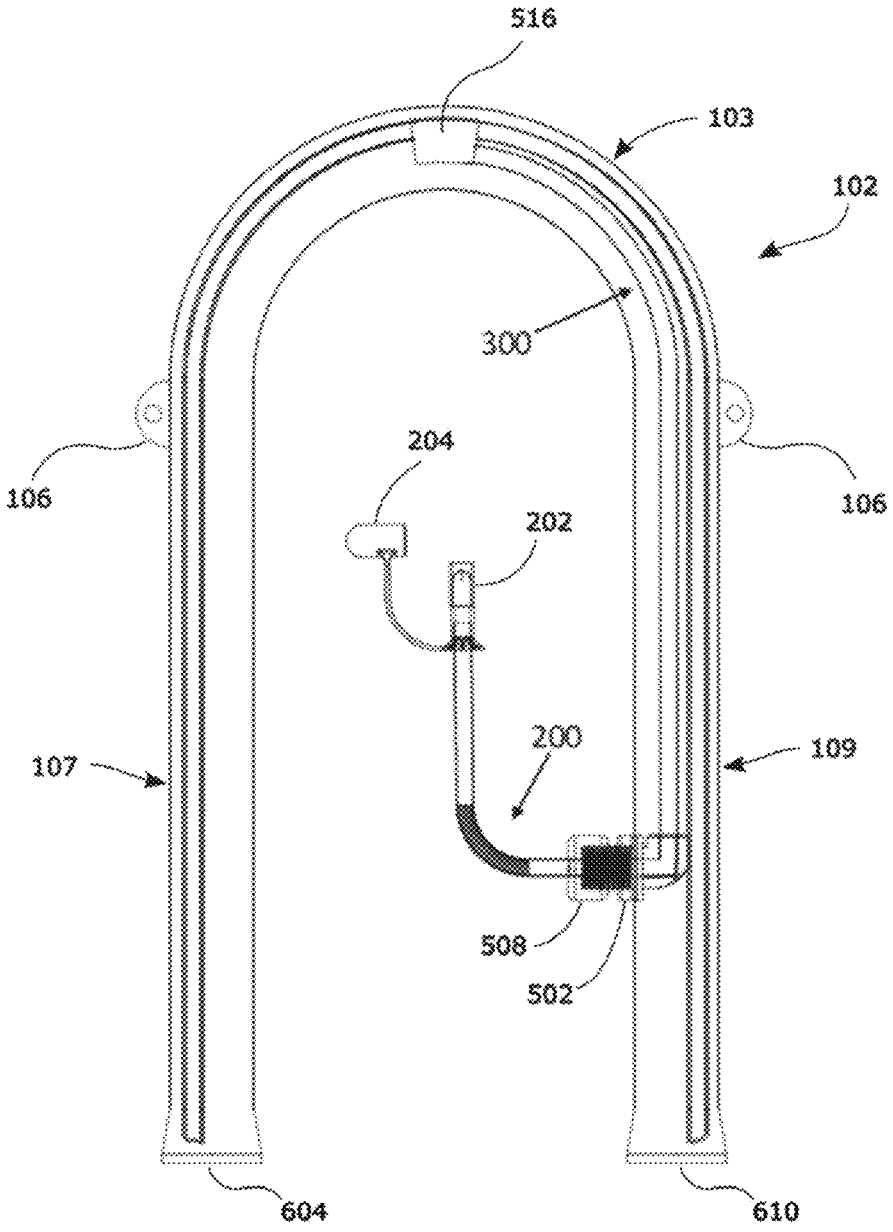
FIG. 2 is a semi-transparent front view of the hydration scarf of FIG. 1, showing an internal tubing configuration and straw assembly connections.

With reference to FIG. 2, the straw assembly 200 enables a user wearing the hydration scarf 100 to drink the beverage contained in the hydration scarf 100 by sucking on the mouthpiece 202 of the straw assembly 200. Since the straw assembly 200 is in fluid communication with the internal tube assembly 300 that is inside the U-shaped container 102, and the ends 604 and 610 (see FIG. 6) of the internal tube assembly 300 are immersed in the beverage (unless the hydration scarf 100 is substantially empty), sucking on the mouthpiece 202 will result in the beverage being drawn into the mouth of the person seeking to drink the beverage contained in the hydration scarf 100. Also shown is the protective cap 204 of the straw assembly 200.

Figure 3:
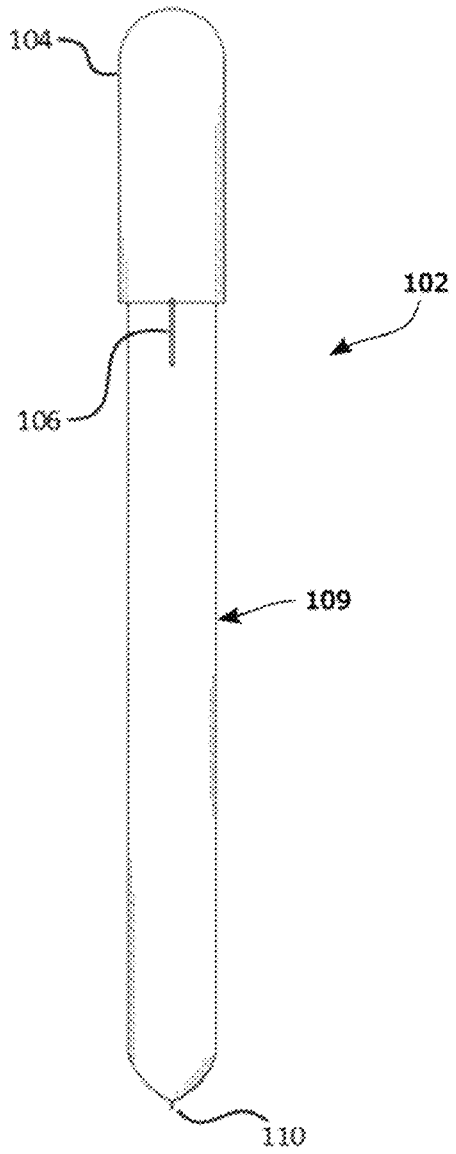
FIG. 3 is a side view of the hydration scarf of FIG. 1, showing the U-shaped container with the insulated upper portion, and a tab for attaching the U-shaped container to a garment.

With reference to FIG. 3, a side view of the hydration scarf 100 is shown, showing the U-shaped container 102 having a thermal insulation sheath 104 and the securing tab 106. The second hanging portion 109 is sealed at the end 110.

Figure 4:
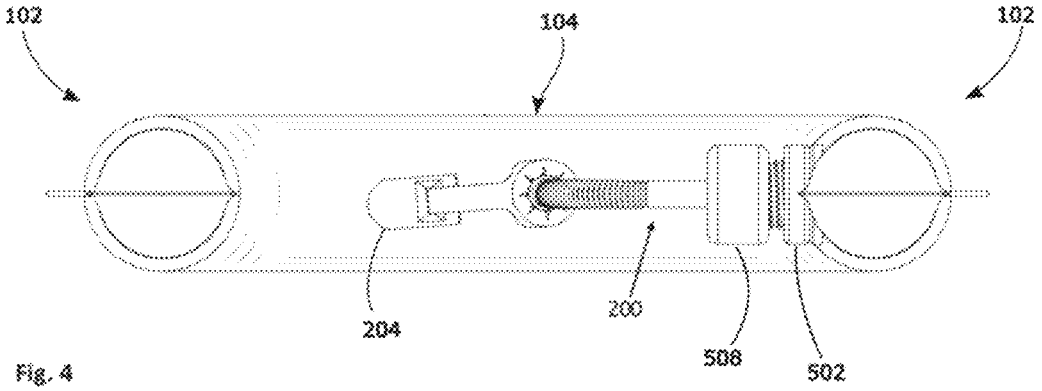
FIG. 4 is a bottom view of the hydration scarf of FIG. 1, showing the U-shaped container, and the straw assembly for drinking the beverage.
Figure 5:
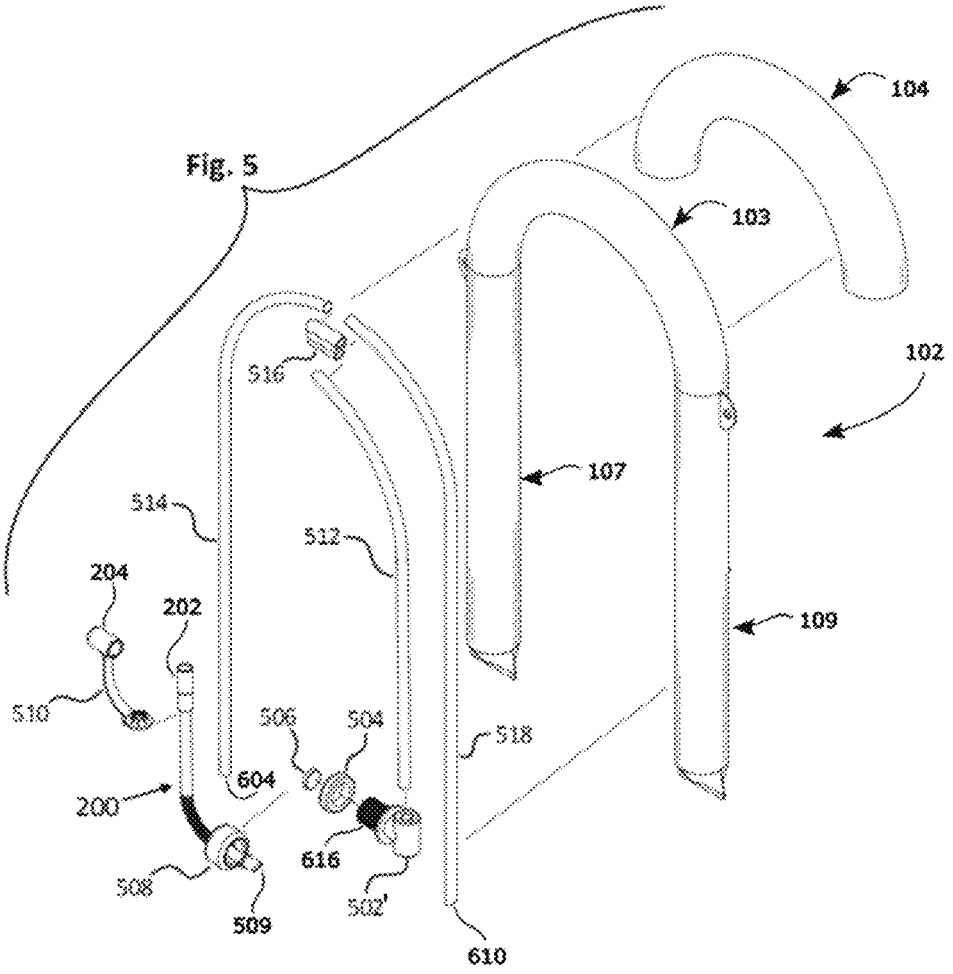
FIG. 5 is an exploded view of the hydration scarf of FIG. 1, showing the insulation portion, the U-shaped container, internal tubing configuration, and the straw assembly with connections.

With reference to FIG. 4, a bottom view of the hydration scarf 100 show, the drinking straw assembly 200 is connected through a side of the U-shaped container 102 via the fluid port 502 and the port connector 508. The curved portion of 102 has the thermal insulation sheath 104 that is configured to contact a person's neck so as to provide thermal insulation. Also shown is the protective cap 204 of the straw assembly 200. With reference to FIG. 5, the center curved portion 103 of the U-shaped container 102 is at least partially covered by the thermal insulation sheath 104 so as to inhibit heat flow from the person's neck to U-shaped container 102.

A connector fitting 502' extends from the inside of the U-shaped container 102 to the outside of the U-shaped container 102, and seals against the wall of the U-shaped container 102 with a locking nut 504 so as to prevent leakage of the beverage. The inside of the connector fitting 502' houses a pierceable membrane 506 that when the straw system 200 is secured with a nut 508 to the connector fitting 502', assures that there is no leakage. The chiseled end 509 extends through the pierceable membrane 506 when the port connector 508 is fully engaged with the fluid port 502.

A protective cap 204 is connected via cap connector 510 to the straw 702 of the drinking straw assembly 200.

The connector fitting 502' connects with intermediate tube 512 on the inside (see also FIG. 2 and FIG. 6) of the U-shaped container 102. The intermediate tube 512 connect to and is in fluid communication with a three-way connector 516. The three-way connector 516 is connected both to a first uptake tube 514 and to a second uptake tube 518. The first and second uptake tubes 514 and 518 each descend downward to the bottoms 108 and 110 of both sides of the U-shaped container 102, such that the ends 604 and 610 of the tubes 514 and 518, respectively, rest substantially at the bottoms 108 and 110, respectively, of the U-shaped container 102.

Since the three-way connector 516 is located at the center and top-most portion of the beverage holding tube 102 when worn on the neck of the person, the person sucking on the straw assembly 200 causes suction to act within the intermediate tube 512, which causes substantially equal vacuum pressure to draw the beverage equally from both sides of the U-shaped container 102, via the first uptake tube 514 and the second uptake tube 518, which are the same length and are at substantially similar vacuum pressures.

Figure 6:
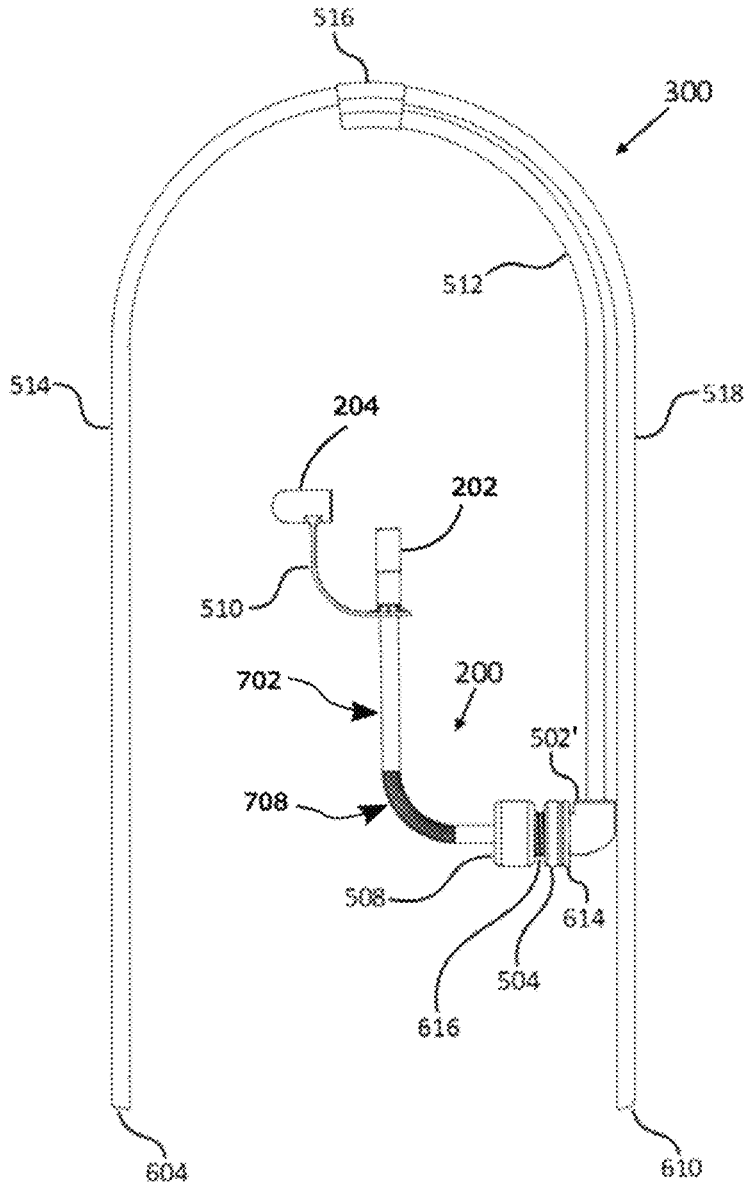
FIG. 6 is a front view of the hydration scarf of FIG. 1, showing the internal tubing configuration and the straw assembly with connections.

With reference to FIG. 6, the first uptake tube 514 has one end 604 which can be serrated so as to prevent the end 604 from sealing against an inner surface of the bottom 108 of the U-shaped container 102 when the wearer of the hydration scarf 100 draws beverage via the straw assembly 200. The end 610 of the tube 518 can be similarly serrated, and for the same reason.

The intermediate tube 512 has one end connected inside the three-way connector 516 and the other end connected inside the connector fitting 502' that has a nut stop flange 614 and a locking nut 504 that form a compression fitting to hold the connector fitting 502 in place without leakage. The connector fitting 502' has a threaded portion 616 to accept the straw system 200 with the straw locking nut 508 applied to the threaded portion 616 of the connector fitting 502. The protective cap 204 is connected to the straw 702 using the cap connector 510. The protective cap 204 can be used to cover and protect the mouthpiece 202 when not in use.

The straw portion 702 has an accordion-folded portion 708 that maintains a shape chosen by the user, and can expand and contract so as to make the length of the straw portion 702 increase or decrease as needed.

Figure 7:
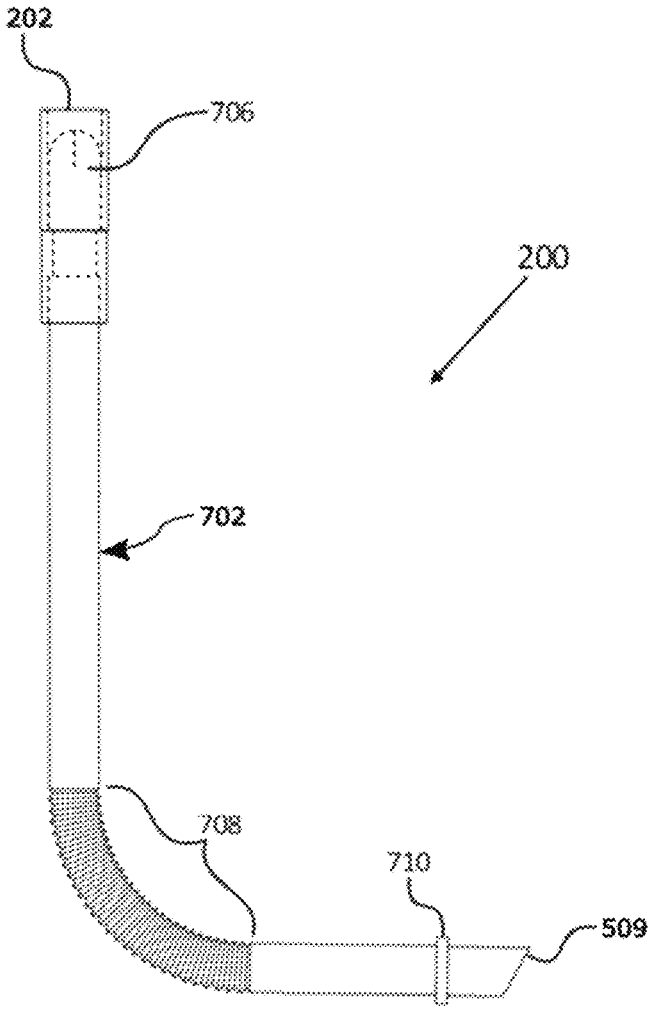
FIG. 7 is a front view of the straw assembly of the hydration scarf of FIG. 1.

With reference to FIG. 7, the straw system 200 has a straw portion 702 with a mouthpiece 202 at a first end, and a fluid pressure threshold valve 706 within the mouthpiece 202. The fluid pressure threshold valve 706 allows fluid to flow only when a fluid pressure exceeds a pressure threshold, such as when a person applies suction with their mouth upon the mouthpiece 202. The straw portion 702 has an accordion-folded portion 708 that maintains a shape chosen by the user, and can expand and contract so as to make the length of the straw portion 702 increase or decrease as needed. The second end 509 of the straw 702 has a chiseled or angle-cut shape so as to make it sharp enough to cut into the membrane 506 (as shown in FIG. 5). The straw portion 702 also includes a stop flange 710 so that the straw portion stops after the second straw end 509 penetrates the membrane 506.

Other modifications and implementations will occur to those skilled in the art without departing from the spirit and the scope of the invention as claimed. Accordingly, the above description is not intended to limit the invention, except as indicated in the following claims.

What is claimed is:

1. A hydration scarf for conveniently containing, carrying, and consuming a beverage, the hydration scarf comprising:

a U-shaped container portion including:

a first hanging portion, a second hanging portion, both the first hanging portion and the second hanging portion having at least one connection tab configured to attach to a user's garment, a curved portion connecting the first hanging portion with the second hanging portion, and a fluid port located at a fluid port location along the U-shaped container portion;

a drinking straw assembly including:

a drinking straw having a first straw end and a second straw end, and a port connector attached to the second end of the straw, the port connector being configured to removably connect the second end of the straw to the fluid port; and an internal tube assembly disposed within the U-shaped container portion, the internal tube assembly including:

a first uptake tube configured to extend into the first hanging portion, a second uptake tube configured to extend into the second hanging portion, and a three-way connector in fluid communication with the fluid port, the three-way connector also being directly connected to the first uptake tube and the second uptake tube.

* * * * *